US005736064A

United States Patent [19]

Edamura et al.

[11] Patent Number: 5,736,064

[45] Date of Patent: Apr. 7, 1998

[54] ELECTRORHEOLOGICAL FLUID COMPOSITION CONTAINING INORGANIC/ ORGANIC COMPOSITE PARTICLES

[75] Inventors: Kazuya Edamura, Tokyo; Yasufumi Otsubo, Chiba; Masataka Mizoguchi, Tokyo, all of Japan

[73] Assignee: Fujikura Kasei Co., Ltd., Tokyo, Japan

[21] Appl. No.: 638,855

[22] Filed: Apr. 29, 1996

Related U.S. Application Data

[63] Continuation of Ser. No. 286,414, Jul. 13, 1994, abandoned.

[30] Foreign Application Priority Data

Jul. 15, 1993 [JP] Japan ..... 5-175706

[51] Int. Cl.$^6$ ..... C10M 171/00; C10M 169/04

[52] U.S. Cl. ..... 252/74; 252/572

[58] Field of Search ..... 252/572, 74

[56] References Cited

FOREIGN PATENT DOCUMENTS 0394049 10/1990 European Pat. Off. .

0455362A2 11/1991 European Pat. Off. .

0562978 9/1993 European Pat. Off. .

63-97694 4/1988 Japan .

64-6093 1/1989 Japan .

2-235994 9/1990 Japan .

*Primary Examiner*—Christine Skane

*Attorney, Agent, or Firm*—Finnegan, Henderson, Farabow, Garrett & Dunner, L.L.P.

[57] ABSTRACT

An electrorheological fluid composition wherein inorganic/organic composite particles comprising a core 1 comprising organic polymeric compound and a shell 3 comprising inorganic microparticles 2 which are electrically semiconducting in a semiconducting region in which conductivity is within a range of $10^{3-10-11}$ $\Omega^{-1}$/cm at room temperature, are dispersed in an electrically insulating medium. These inorganic/organic composite particles are produced by means of a method in which the cores 1 and the shells 3 are simultaneously formed, and the surfaces thereof are preferably polished. An electrorheological fluid composition possessing electrorheological effects, having superior storage stability, capable of use over long periods, having little abrasiveness, which is not affected by environmental temperature or humidity, a current value of which is stable, and which has little power consumption.

5 Claims, 1 Drawing Sheet

ELECTRORHEOLOGICAL FLUID COMPOSITION CONTAINING INORGANIC/ ORGANIC COMPOSITE PARTICLES

This application is a continuation of application Ser. No. 08/286,414, filed Jul. 13, 1994, now abandoned.

BACKGROUND OF THE INVENTION

1. Field of the Invention

The present invention relates to an electrorheological fluid composition which can be used, for example, in instruments for braking or for power transmission, such as clutches, dampers, shock absorbers, valves, actuators, vibrators, printers, vibrating devices, or the like, and more specifically, relates to an electrorheological fluid composition which stably generates large resistance to shearing flow by means of the application of an external electric field.

2. Background Art

Conventionally, compositions termed "electrorheological fluids" (hereinbelow referred to as "ER fluids") are known. These compositions are fluids which are obtained by dispersing solid particles in a medium having electric insulation properties, for example, and when an external electric field is applied thereto, the viscosity thereof increases markedly, and in certain cases, such a liquid may solidify; these are thus fluid compositions possessing the so-called "electrorheological effect" (hereinbelow referred to as the "ER effect").

This type of ER effect is also termed a "Winslow effect"; the effect is thought to be produced by the polarization of the solid particles dispersed in the electrically insulating medium by means of the action of the electric field produced between electrodes when voltage is applied to a composition disposed between the electrodes, and by the alignment and bridging in the direction of the electric field by means of electrostatic attraction based on this polarization, and the resistance to an external shearing flow.

ER fluids possess the ER effect described above, so that they are expected to find applications in instruments for braking or for power transmission operating by electrical control, such as clutches, dampers, shock absorbers, valves, actuators, vibrators, printers, vibrating devices, or the like.

However, conventionally known ER fluids possessed various problems.

Conventionally, ER fluids were known in which solid particles having surfaces which adsorbed and retained water, such as silica gel particles, cellulose particles, starch particles, casein particles, or polystyrene-type ion exchange resin particles, or the like, were dispersed in electrically insulating oils such as silicone oil, diphenyl chloride, transformer oil, or the like; however, these possessed insufficient resistance to external shearing flow during the application of voltage (hereinbelow referred to as "the shearing resistance"), and furthermore, required a high applied voltage, had a large power consumption, and as a result of water adsorption of the solid particles or the like, current sometimes flowed abnormally, and the particles tended to migrate to one electrode and to precipitate thereon, and in addition, storage stability was also poor. Furthermore, when the water which was adsorbed by the particles was desorbed or evaporated as a result of heating and the water content of the particles changed, the electrorheological characteristics (hereinbelow referred to as "ER characteristics") changed as a result, and accordingly, there were problems in that the thermal resistance and resistance to moisture were poor, and the like.

In order to solve these problems, for example, an ER fluid (Japanese Patent Application, First Publication, Laid-Open No. Hei 2-91194) was proposed in which inorganic solid particles incorporating semiconductors and having low electric conductivity were used as the solid particles and were dispersed in an electrically insulating oil, and an ER fluid (Japanese Patent Application, First Publication, Laid-Open No. Hei 3-200897) was proposed in which inorganic ion exchange particles comprising hydroxides of polyvalent metals, hydrotalcites, acid salts of polyvalent metals, hydroxyapatite, Nasicon (Na ion superionic conductor)-type compounds, clay minerals, potassium titanates, heteropolyacid salts, or insoluble ferrocyanides were used as the solid particles and were dispersed in an electrically insulating oil. However, the difference in specific gravities between such inorganic solid particles and the electrically insulating oils which were used as the dispersion medium was large, so that when such a liquid was stored for a long period of time, the particles were precipitated, and the particles which were thus precipitated cohered to such an extent that they were not easily redispersed, and thus the storage stability of these fluids was poor. Furthermore, as these inorganic solid particles were extremely hard, when such particles collided with the electrodes which were used for the application of voltage or with the walls of apparatuses, they were abraded and damaged by the particles, and furthermore, the fragments which were scraped off by these collisions and were suspended in the ER fluid altered the ER characteristics, causing problems in that large, abnormal currents would flow from time to time, or suddenly, and thus the fluid could only be used for a short period of time.

Furthermore, particularly in the case in which inorganic ion exchange particles were used which had a large electric conductivity, when a voltage was applied to the electrodes, a very large current flowed through the ER fluid and abnormal heating occurred, and this was undesirable in that it consumed an extremely large amount of electric power.

In addition, a fluid was disclosed (Japanese Patent Application, First Publication, Laid-Open No. Hei 3-162494) which used, as the solid particles, particles which were obtained by using material having a specific gravity of 1.2 or less as a core, and then covering this core material with an organic polymeric compound having an anion group or a cation group which was dissociable in water. However, in this case, as the particles were water-bearing, when the water content of the particles changed as a result of an increase in the temperature of the system in which they were used or the like, the electric conductivity and polarization percentage of the liquid changed, and as a result, there were problems such as a change in the ER characteristics of the composition as a result of the temperature of the environment.

SUMMARY OF THE INVENTION

It is an object of the present invention to provide an electrorheological fluid composition which solves the problems described above, and which possesses a high ER effect, has superior storage stability, and has a long service life, causes little abrasion, is little affected by environmental temperature or humidity, and which furthermore has a stable current value and consumes little power.

The electrorheological fluid composition of the present invention comprises inorganic/organic composite particles dispersed in an electrically insulating medium. The inorganic/organic composite particles consists of a core consisting essentially of organic polymeric compound, and a shell consisting essentially of an electrically semiconducting inorganic material which has an electrical conductivity within a range of $10^3$–$10^{-11}$ $\Omega^{-1}$/cm at room temperature.

The ER fluid composition in accordance with the present invention is obtained by dispersing inorganic/organic composite particles comprising a core comprising organic polymeric compounds and a shell comprising an electrically semiconducting inorganic material, in an electrically insulating medium, so that high ER effects are obtained, the composition possesses superior stability over time, possesses low abrasion so that the electrodes or walls of apparatuses are not abraded, and the current which flows when voltage is supplied is small, so that there is no danger of abnormal heating, the power consumption is small, and the composition is thus economical. The surfaces of the inorganic/organic composite particles may be subjected to polishing.

Furthermore, if the inorganic/organic composite particles described above are manufactured according to a method in which the cores and the shells are simultaneously formed, durable inorganic/organic composite particles can be obtained, so that the electrorheological fluid composition employing these particles suffers little degradation as a result of abrasion during use, and the composition can be used for a long period of time.

DETAILED DESCRIPTION OF THE INVENTION

Figure 1:
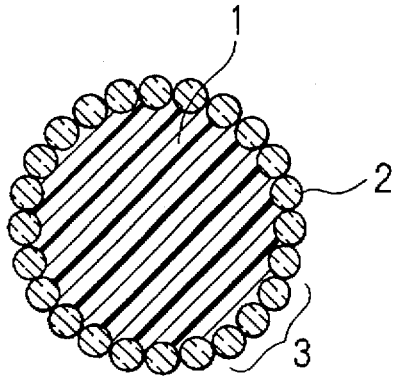
FIG. 1 is a cross sectional view showing an inorganic/organic composite particle which is employed in the electrorheological fluid composition in accordance with the present invention.

In the present invention, it is preferable that the electrically semiconducting inorganic material comprising the shells comprise at least one of an inorganic material, comprising at least one selected from metal oxides, metal hydroxides, hydroxides of metal oxides, and inorganic ion exchangers, subjected to metallic doping; and an inorganic material in which, regardless of the presence or absence of metal doping, at least one of the above is executed as an electrically semiconducting layer on another support member.

Furthermore, it is preferable that the inorganic/organic composite particles in the present invention be particles manufactured in accordance with a method in which the cores and the shells thereof are simultaneously formed. In this case, it is preferable that the surfaces of the inorganic/organic composite particles described above be polished.

The electrorheological fluid composition of the present invention is fundamentally obtained by dispersing inorganic/organic composite particles in an electrically insulating medium; these inorganic/organic composite particles are formed by means of a core comprising an organic polymeric compound and shells comprising the electrically semiconducting inorganic material described above. It was confirmed that the electrorheological fluid composition of the present invention having this type of structure possesses superior ER effects, can be used for a long period of time, and causes little abrasion of apparatuses.

Next, the components comprising the present invention will be explained in detail.

Examples of the organic polymeric compound which can be used as the core of the inorganic/organic composite particles include, for example, one or a mixture or copolymers of two or more of poly(meth)acrylic ester, (meth) acrylic ester-styrene copolymer, polystyrene, polyethylene, polypropylene, nitrile rubber, butyl rubber, ABS resin, nylon, polyvinyl butylate, ionomer, ethylene-vinyl acetate copolymer, vinyl acetate resin, polycarbonate resin, or the like.

Furthermore, it is possible to use the organic polymeric compounds described above in a form in which they contain functional groups such as hydroxyl groups, carboxyl groups, amino groups, or the like; such organic polymeric compounds containing functional groups are preferable, as they increase the ER effects.

Examples of the electrically semiconducting inorganic material which is preferably employed as the shells in the inorganic/organic composite particles include, for example, metal oxides, metal hydroxides, hydroxides of metal oxides, or inorganic ion exchangers, having an electrical conductivity within a range of $10^3$–$10^{-11}$ $\Omega^{-1}$/cm at room temperature, or at least one of the above which has been subjected to metal doping, or irrespective of the presence or absence of metal doping, at least one of the above, executed as an electrically semiconducting layer on another supporting member, and the like. Among these electrically semiconducting inorganic materials, examples of the inorganic ion exchanger include, for example, hydroxides of polyvalent metals, hydrotalcites, acid salts of polyvalent metals, hydroxyapatites, Nasicon-type compounds, clay minerals, potassium titanates, heteropoly acid salts, and insoluble ferrocyanides. These exhibit superior electrorheological effects when solid particles thereof are dispersed in an electrically insulating medium.

Hereinbelow, detailed explanation will be given with respect to these various electrically semiconducting inorganic substances.

(1) Metal oxides: these include, for example, $SnO_2$, amorphous titanium dioxide (produced by Idemitsu Petrochemical Co., Ltd.), and the like.

(2) Metal hydroxides: these include, for example, titanium hydroxide, niobium hydroxide, and the like.

Here, titanium hydroxide encompasses water-bearing titanium oxide (produced by Ishihara Sangyo Kaisya, Ltd.), metatitanic acid (also called β-titanic acid, $TiO(OH)_2$), and orthotitanic acid (also called α-titanic acid, $Ti(OH)_4$).

(3) Hydroxides of metal oxides: examples hereof include, for example, FeO(OH) (gacite), and the like.

(4) Hydroxides of polyvalent metals: these compounds are represented by the formula $MO_x(OH)_y$ (where M represents a polyvalent metal, x indicates a number having a value of 0 or greater, and y represents a positive number); for example, zirconium hydroxide, bismuth hydroxide, tin hydroxide, lead hydroxide, aluminum hydroxide, tantalum hydroxide, molybdenum hydroxide, magnesium hydroxide, manganese hydroxide, iron hydroxide, and the like.

(5) Hydrotalcites: these compounds are represented by the general formula $M_{13}Al_6(OH)_{43}(Co)_3.12H_2O$ (where M represents a bivalent metal); examples of the bivalent metal M include Mg, Ca, Ni, and the like.

(6) Acid salts of polyvalent metals: examples hereof include, for example, titanium phosphate, zirconium phosphate, tin phosphate, cerium phosphates, chromium phosphates, zirconium arsenate, titanium arsenate, tin arsenate, cerium arsenate, titanium antimonate, tin antimonate, tantalum antimonate, niobium antimonate, zirconium tungstate, titanium vanadate, zirconium molybdate, titanium selenate, tin molybdate, and the like.

(7) Hydroxyapatites: these include, for example, calcium apatite, lead apatite, strontium apatite, cadmium apatite, and the like.

(8) Nasicon-type compounds: these encompass compounds such as, for example, $(H_3O)Zr_2(PO_4)_3$, and the like; however, in the present invention, it is also possible to use a Nasicon-type compound in which $(H_3O)$ has been replaced by Na.

(9) Clay minerals: these include, for example, montmorillonite, sepiolite, bentonite, and the like; sepiolite is particularly preferable.

(10) Potassium titanates: these are represented by the general formula $aK_2O.bTiO_2.nH_2O$ (where a represents a positive number such that $0<a\leqq 1$; b represents a positive number such that $1\leqq b\leqq 6$; and n represents a positive number); for example, these include $K_2.TiO_2.2H_2O$, $K_2O.2TiO_2.2H_2O$, $0.5K_2O.TiO_2.2H_2O$, $K_2O.2.5TiO_2.2H_2O$, and the like.

In the general formula above, compounds in which a or b are not integers can be easily synthesized by the acid treatment of a compound in which a or b are appropriate integers, and the replacement of K with H.

(11) Heteropoly-acid salts: these are represented by the general formula $H_3AE_{12}O_{40}.nH_2O$ (where A represents phosphorus, arsenic, germanium, or silicon; E represents molybdenum, tungsten, or vanadium; and n represents a positive number); these include, for example, ammonium molybdophosphate, and ammonium tungstosphosphate.

(12) Insoluble ferrocyanides: these are represented by the following general formula: $M_{b-pxa}A[E(CN)_6]$ (In the formula, M indicates an alkali metal or a hydrogen ion; A represents a heavy metal ion such as zinc, copper, nickel, cobalt, manganese, cadmium, iron (III), or titanium or the like; E represents iron (II), iron (III), cobalt (II) or the like; b represents 4 or 3; a represents the valence number of A; and p represents a positive number within a range of 0–b/a.)

Included in this are, for example, insoluble ferrocyanide compounds such as $Cs_2Zn[Fe(CN)_6]$ and $K_2Co[Fe(CN)]_6$, and the like.

The inorganic ion exchangers of (4)–(9) above all possess OH groups, and exchangers (hereinbelow termed "substitutional inorganic ion exchangers"), which have a portion or all of the ions at the ion exchange site of the inorganic ion exchanger substituted with other ions, are also included in the inorganic ion exchanger in accordance with the present invention.

That is to say, when the inorganic ion exchangers described above are represented by the formula $R\text{-}M^1$ (where $M^1$ represents the ions of the ion exchange site), substitutional inorganic ion exchangers in which a portion or all of $M^1$ in $R\text{-}M^1$ has been substituted with ions $M^2$, differing from $M^1$, by means of the ion exchange reaction described hereinbelow, can also be used as the inorganic ion exchanger in accordance with the present invention.

$$xR\text{-}M^1+yM^2Rx\text{-}(M^2)y+xM^1$$

(Here, x and y represent the valence numbers of ions $M^2$ and $M^1$, respectively.)

$M^1$ differs based on the type of inorganic ion exchanger containing an OH group; however, in inorganic ion exchangers which exhibit an ability to exchange cations, $M^1$ is typically $H^+$, and in this case, $M^2$ represents at least one metal ion other than $H^+$, such as alkali metal ion, alkali earth metal ion, polyvalent typical species metal ion, transition metal ion, rare earth metal ion, or the like.

In inorganic ion exchangers possessing OH groups which exhibit an ability to exchange anions, $M^1$ represents, in general, $OH^-$, and this case, $M^2$ represents at least one anion selected from all anions other than $OH^-$, such as, for example, I, Cl, SCN, $NO_2$, Br, F, $CH_3COO$, $SO_4$, $CrO_4$, or the like, or a complex ion.

Furthermore, with respect to inorganic ion exchangers which have temporarily lost their OH groups as a result of a high temperature heating process, but have re-acquired OH groups by means of immersion in water or the like, such post-high temperature heating process inorganic ion exchangers also represent a type of inorganic ion exchanger which may be used in the present invention; concrete examples thereof include Nasicon-type compounds, for example, $HZr_2(PO_4)_3$, which is obtained by heating $(H_3O)Zr_2(PO_4)_3$, and high-temperature heat-processed hydrotalcite materials (heat processed at a temperature within a range of 500°–700° C.), and the like.

(13) Metal-doped electrically semiconducting inorganic materials: these are materials in which an electrically semiconducting inorganic material is doped with a metal such as antimony (Sb) or the like, in order to increase the electric conductivity of the above-described electrically semiconducting inorganic materials (1)–(12); examples thereof include antimony (Sb)-doped tin oxide ($SnO_2$) and the like.

(14) Materials in which an electrically semiconducting inorganic material is executed as an electrically semiconducting layer on another supporting member: examples hereof include, for example, materials in which inorganic particles such as titanium oxide, silica, alumina, silica-alumina, barium sulfate ($BASO_4$), or the like, or organic polymeric particles such as polyethylene, polypropylene, or the like, are used as the support member, and antimony (Sb)-doped tin oxide ($SnO_2$) is executed thereon as an electrically semiconducting layer, and the like. Particles to which electrically semiconducting inorganic materials are applied in this manner function as electrically semiconducting inorganic materials as a whole.

It is possible to use not merely one type of such electrically semiconducting inorganic materials, but rather to use two or more types thereof simultaneously in the shells.

In order to sufficiently produce the effects particular to this invention, among the electrically semiconducting inorganic materials indicated in (1)–(14) above, it is particularly preferable to use (1) metal oxides, (2) metal hydroxides, (3) hydroxides of metal oxides, (4) hydroxides of polyvalent metals, (13) metal-doped electrically semiconducting inorganic materials, or (14) electrically semiconducting inorganic materials applied to another support member as an electrically semiconducting layer.

All electrically insulating media which were used in conventional ER fluids may be used as the electrically insulating medium used in the composition of the present invention. For example, any fluid may be used which has high electric insulation and electric insulation breakdown strength, is chemically stable, and in which the inorganic/organic composite particles may be stably dispersed, examples thereof including diphenylchloride, butyl sebacate, aromatic polycarbonate higher alcohol ester, halophenylalkylether, transformer oil, paraffin chloride, fluorine-containing oil, silicone-containing oil, perfluoro carbon oil, or the like; mixtures thereof may also be used.

The inorganic/organic composite particles used in the present invention are formed by means of a core comprising organic polymeric compound and a shell comprising electrically semiconducting inorganic material. That is to say, as is shown schematically in FIG. 1, the surface of a core 1 comprising organic polymeric compound is covered by the deposition of microparticles 2 of an electrically semiconducting inorganic material in a layer shape, and shell 3 is thus formed.

This type of inorganic/organic composite particle may be manufactured by means of various methods.

For example, a method is known in which core particles 1 comprising organic polymeric compound and microparticles 2 comprising electrically semiconducting inorganic material are blown in a jet stream and caused to collide. In this case, the electrically semiconducting inorganic material microparticles 2 collide with the surface of the core particles 1 at high speed, adhere thereto, and form shells 3.

Furthermore, a different manufacturing method is known in which core particles 1 are suspended in a gas and microparticles of an electrically semiconducting inorganic material 2 in a solution in spray form is sprayed onto the surfaces thereof. In this case, the microparticles of electrically semiconducting inorganic materials 2 in a solution is deposited on the surfaces of core particles 1 and is dried, and thereby shells 3 are formed.

However, the preferable method for the manufacture of the inorganic/organic composite particles is a method in which core 1 and shell 3 are simultaneously formed.

In such a method, for example, when the organic polymeric compound monomer forming core 1 is subjected to emulsion polymerization, suspension polymerization, or dispersion polymerization in a polymerization medium, the electrically semiconducting inorganic material microparticles 2 are placed in the monomer described above, or are caused to be present in the polymerization medium.

Water is preferable as the polymerization medium; however, it is also possible to use a mixture of water and a water-soluble organic solvent, or to use an organic poor solvent.

In accordance with such a method, simultaneously with the polymerization of the monomers in a polymerization medium and the formation of the core particles 1, the electrically semiconducting inorganic material microparticles 2 are arranged in a layer form on the surface of the core particles 1 and cover these core particles 1, thus forming shells 3.

In the case in which the inorganic/organic composite particles are produced by means of emulsion polymerization or suspension polymerization, by means of combining the hydrophobic characteristics of the monomer and the hydrophilic characteristics of the electrically semiconducting inorganic material, it is possible to orient the majority of the electrically semiconducting inorganic material microparticles on the surface of the core particles. By means of this method in which core 1 and shell 3 are simultaneously formed, the electrically semiconducting inorganic material particles 2 are minutely, discretely and strongly adhered to the surface of the core particles 1 comprising organic polymeric compound, and thus durable inorganic/organic composite particles are formed.

The shape of the inorganic/organic composite particles used in the present invention is not necessarily limited to a spherical shape; however, in the case in which the core particles are manufactured by means of a regulated emulsion or suspension polymerization method, the form of the inorganic/organic composite particles which are obtained is nearly completely spherical.

The particle diameter of the inorganic/organic composite particles is not particularly restricted; however, a range of 0.1–500 μm, and in particular, a range of 5–200 μm, is preferable.

The particle diameter of the electrically semiconducting inorganic material microparticles 2 is not particularly restricted; however, a range of 0.005–100 μm is preferable, and a range of 0.01–10 μm is still more preferable.

In this type of inorganic/organic composite particle, the weight ratio (%) of the electrically semiconducting inorganic material forming the shells 3 and the organic polymeric compound forming cores 1 is not particularly restricted; however, it is preferable that the ratio [electrically semiconducting inorganic material]:[organic polymeric compound] be within a range of 1:99–60:40, and it is still further preferable that it be within a range of 4:96–30:70. If the weight ratio of the electrically semiconducting inorganic material is less than 1%, the ER effects of the ER fluid composition which is obtained will be insufficient, while when this ratio exceeds 60%, an excessively large current will flow in the fluid composition which is obtained.

When the inorganic/organic composite particles are manufactured by means of the methods described above, especially the method in which cores 1 and shells 3 are simultaneously formed, it has become clear through analysis that a portion or entirety of surfaces of the shells 3 of the inorganic/organic composite particles are covered with a thin layer of an organic polymeric material or an additive used in the process of manufacturing, such as a dispersant, an emulsifier, or the like. Accordingly, it is observed that the ER effects of the electrically semiconducting inorganic material microparticles cannot be sufficiently exhibited (see Example 14). This type of thin layer of inactive material can be removed by means of polishing the surfaces of the particles.

Accordingly, in the preferable electrorheological fluid composition in accordance with the present invention, inorganic/organic composite particles having polished surfaces are employed.

However, in the case in which the inorganic/organic composite particles are produced by means of a method in which cores 1 are first formed and then shells 3 are formed thereon, no inactive material is present on the surfaces of shells 3, and the ER effects of the electrically semiconducting inorganic material are sufficiently large, so that polishing is not absolutely necessary.

The polishing of the particle surfaces can be accomplished by a variety of methods.

For example, it is possible to conduct this polishing by means of dispersing the inorganic/organic composite particles in a dispersion medium such as water or the like, and by agitating this. At this time, it is possible to conduct this polishing by means of a method in which a polishing material such as grains of sand or balls is mixed into the dispersion medium and is agitated along with the inorganic/organic composite particles, or by means of a method in which agitation is conducted using a grinding stone.

Furthermore, it is possible to conduct agitation without the use of a dispersion medium by employing a dry process using the inorganic/organic composite particles and a polishing material or a grinding stone such as those described above.

A more preferable polishing method is a method in which the inorganic/organic composite particles are subjected to airstream-blown agitation in a jet air stream or the like. This is a method in which the particles themselves collide violently with one another in the gas and are thus polished, so that other polishing material is unnecessary, and the inactive materials which are separated from the particle surfaces can be easily separated by means of classification, so that such a method is preferable.

In this jetstream-blown agitation, it is difficult to specify the type of apparatus employed, the agitation speed, and the polishing conditions, as a result of the qualities of the inorganic/organic composite particles; however, in general, an agitation speed of 6000 rpm and a jetstream-blown agitation time within a range of 0.5–15 minutes are preferable.

It is possible to produce the electrorheological fluid composition of the present invention by agitating and mixing the above-described inorganic/organic composite particles uniformly in an electrically insulating medium, and where necessary, together with other components such as dispersants or the like.

Any agitator which is normally used for dispersing solid particles in a liquid dispersion medium may be used as an agitator for this purpose.

The percentage of inorganic/organic composite particles present in the electrorheological fluid composition of the present invention is not particularly restricted; however, a range of 1–75 weight percent is preferable, and in particular, a range of 10–60 weight percent is more preferable. When the percentage contained thereof is less than 1%, sufficient ER effects cannot be obtained, while when the percentage contained exceeds 75%, the initial viscosity of the composition when a voltage is not applied is excessively large, so that the use thereof is difficult.

The electrorheological fluid composition in accordance with the present invention having the composition described above comprises solid particles, the shells of which comprise electrically semiconducting inorganic material, dispersed in an electrically insulating medium, so that the composition possesses ER effects.

These inorganic/organic composite particles are formed with a shell comprising electrically semiconducting inorganic material possessing strong ER effects, so that an ER fluid composition in accordance with the present invention using such particles generates a large shearing resistance even with respect to a low applied voltage.

Furthermore, in the case in which a electrically semiconducting inorganic material having a large electric conductivity is employed, it is possible to adjust the weight ratio of the shell material with respect to the core material of the inorganic/organic composite particles, so that by means of this, it is possible to adjust the conductivity, and thus to restrain abnormal heating and power consumption while the ER fluid composition is electrically charged.

In the present invention, the cores of the inorganic/organic composite particles are comprising organic polymeric compounds, so that it is possible to cause the specific gravity thereof to approach the specific gravity of the above-described electrically insulating medium, and by means of this, the precipitation of the particles can be prevented over long periods of time.

Furthermore, the cores of these inorganic/organic composite particles comprise organic polymeric compound, so that the particles as a whole are soft, even though these particles have shells which are comprising hard inorganic material, and such particles will not cause abrasion of electrodes or instrument walls during use.

In a preferred form of the present invention, the inorganic/organic composite particles are manufactured by means of a method in which the cores and the shells are formed simultaneously, so that the bond between the cores and the shells are strong, and the shells will not strip away from the core as a result of friction and the like during use, which would lead to changes in the characteristics thereof, so that the particles may be used for a long period of time.

At this time, the surfaces of the inorganic/organic composite particles are polished, so that it is possible to maintain ER effects without interfering with the activity of the electrically semiconducting inorganic material which forms the shells. In the case in which nonaqueous electrically semiconducting inorganic material is employed, the inorganic/organic composite particles are a water-free type of dispersion particles, and it is possible to make the ER fluid composition obtained a water-free type of ER fluid composition. What is meant here by "water-free type" is that water is not added in a positive manner in order to apply ER effects, not that no water is included in the system. This type of water-free ER fluid composition possesses the advantage of maintaining stable ER characteristics even if the temperature thereof rises during use and the amount of water contained changes.

The ER fluid composition of the present invention possesses superior ER effects and good stability and low abrasiveness, so that it can be used effectively as a fluid for power transmission or for braking which can be electrically controlled in instruments such as clutches, dampers, shock absorbers, valve, actuators, vibrators, printers, vibrating devices, or the like.

Figure 2:
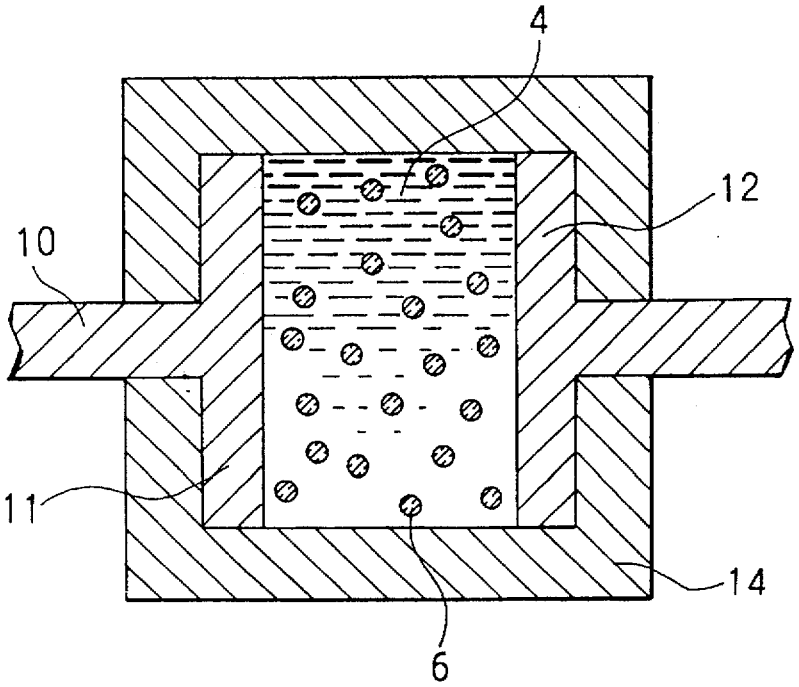
FIG. 2 is a schematic cross sectional diagram showing a clutch in which the electrorheorogical fluid composition of the present invention is used as a power transmission fluid.

FIG. 2 shows a preferred embodiment of the ER fluid of the present invention; a clutch utilizing the ER fluid of the present invention as a power transmission fluid is shown as an example. Reference numeral 4 in the diagram indicates the ER fluid of the present invention; clutch case 14 is filled therewith. Within this clutch case 14, a clutch plate 11, which is on the engine side, and a clutch plate 12, which is on the vehicle axis side, both of which are disk-shaped, are disposed. And an axle 10 is provided integrally in the center of the clutch plate 11. Furthermore, the engine side clutch plate 11 rotates about the axle 10.

Normally, ER fluid 4 is in a state in which the inorganic/organic composite particles 6 are randomly dispersed within electrically insulating medium, and thus possesses fluidity. Accordingly, clutch plate 11 rotates freely within this fluid, and this rotation is not transmitted to the other clutch plate 12.

However, when voltage is applied between these two clutch plates 11 and 12, the inorganic/organic composite particles 6 within the ER fluid are polarized, and are aligned and bridged in the direction of the applied electric field; that is to say, they are aligned and bridged in a direction perpendicular to both clutch plates. Along with this, the viscosity of the ER fluid increases, and the shearing resistance between the clutch plates is increased. In the ER fluid of the present invention, the shearing resistance is large, and exceeds the force at which clutch plate 11 rotates, so that vehicle axle side clutch plate 12 also rotates in concert with the engine side clutch plate 11. That is to say, both axles become firmly bonded, and the rotation of the engine side clutch plate is transmitted to the vehicle side clutch plate.

It is possible to add components other than those described above to the composition of the present invention. Examples thereof include polymeric dispersants, surfactants, polymeric thickeners, or the like, which are used to increase the dispersibility of the inorganic/organic composite particles in the above-described medium, to adjust the viscosity of the fluid composition during application of voltage, and to increase the shearing resistance.

Furthermore, the fluid composition in accordance with the present invention may be used in a mixture with conventional ER fluids in which solid particles comprising polymers or bridging materials of, for example, cellulose, starch, casein, polystyrene-type ion exchange resin, polyacrylate bridger, or azeridine compounds, are dispersed in an electrically insulating oil, such as silicone oil, diphenyl chloride, transformer oil, or the like, insofar as the characteristics of the fluid composition are not thereby lost.

EXAMPLES

Hereinbelow, the present invention will be explained in greater detail by way of embodiments.

Example 1

A mixture of 40 g of antimony-doped tin oxide (produced by Ishihara Sangyo Kaisha, Ltd., SN-100, conductivity: $1.0\times10^{0}\ \Omega^{-1}/cm$), 300 g of butyl acrylate, 100 g of 1,3-butylene glycol dimethacrylate, and polymerization initiator was dispersed in 1800 ml of water containing 25 g of tertiary calcium phosphate as a dispersion stabilizer; this was agitated for a period of 1 hour at a temperature of 60° C. and suspension polymerization was conducted.

The product thus obtained was subjected to filtration, and where necessary, acid cleaning, water rinsing, and drying, and inorganic/organic composite particles (1-A) were obtained. The water content of these particles was measured at 0.30 weight percent by means of Karl Fisher's titration method. Furthermore, the average particle diameter was 23.2 μm.

The inorganic/organic composite particles (1-A) which were thus obtained were subjected to jetstream-blown agitation for a period of 5 minutes at 6,000 rpm using a jetstream agitator (a hybridizer manufactured by Nara Machinery Company, Ltd.), the surfaces thereof were polished, and inorganic/organic composite particles (1-B) were obtained. The water content of these particles was 0.41 weight percent, and the average particle diameter thereof was 25.3 μm.

The inorganic/organic composite particles (1-A) and (1-B) were uniformly dispersed in silicone oil (produced by Toshiba Silicone Company, TSF 451-1000) having a viscosity of 1 Pa·s at room temperature, so that the amount of particles obtained was 33 weight percent, and the ER fluid compositions of Examples (1-A) and (1-B) were thus obtained.

These ER fluid compositions were placed in a coaxial cylinder viscometer, a direct current voltage was applied between the inner and outer cylinders at a temperature of 25° C., and a torque was applied to the inner cylinder electrode, and the shear stress (Pa) at various shear rates ($s^{-1}$), and current density ($\mu A/cm^2$) between the inner and outer cylinder during the measurement of shear stress, were measured.

In the case of the ER fluid composition of Example (1-B), the current value became excessively large during measurement of shear stress, so that the applied voltage wag set at 1 KV/mm. The results are shown in Table 1.

TABLE 1

| Example | | Applied Voltage | Shear Rate ($s^{-1}$) 320 | 191 | 115 | 68.5 | 40.9 | 24.9 | 14.2 | 8.9 | 4.2 | 2.5 | 1.4 |
|---|---|---|---|---|---|---|---|---|---|---|---|---|---|
| 1-A | Shear Stress (Pa) | E = 0 | 950 | 575 | 350 | 221 | 129 | 79.4 | 47.1 | 28.5 | 13.6 | 8.68 | 5.95 |
| | | E = 2 KV/mm | 1030 | 662 | 464 | 360 | 303 | 265 | 243 | 223 | 206 | 201 | 191 |
| | Current Density ($\mu A/cm^2$) | | 13.0 | 18.1 | 31.1 | 54.5 | 88.3 | 125 | 161 | 197 | 260 | 291 | 312 |
| 1-B | Shear Stress (Pa) | E = 0 | 908 | 546 | 327 | 198 | 117 | 70.7 | 43.4 | 26.0 | 12.4 | 7.44 | ** |
| | | E = 1 KV/mm | 1070 | 749 | 560 | 434 | 332 | 273 | 228 | 200 | 186 | 174 | 166 |
| | Current Density ($\mu A/cm^2$) | | 36.4 | 67.5 | 117 | 161 | 213 | 265 | 286 | 312 | 306 | 265 | 286 |

**Could not be measured because of low shear stress

Example 2

The conditions of Example 2 were identical to those of Example 1, with the exception that 40 g of rutile-type titanium oxide (produced by Ishihara Sangyo Kaisha, Ltd., Taipeegu ET-300W, conductivity: $5.0\times10^{-2}\ \Omega^{-1}/cm$) having antimony-doped tin oxide applied to the surface thereof was used in place of the antimony-doped tin oxide used in Example 1; inorganic/organic composite particles (2-A), the surfaces of which were not polished, were obtained. The water content of these particles was 0.36 weight percent, and the average particle diameter was 13.2 μm.

Next, these particles were subjected to jetstream-blown agitation in a manner identical to that of Example 1, and inorganic/organic composite particles (2-B), the surfaces of which were polished, were obtained. The water content of these particles was 0.28 weight percent, and the average particle diameter was 15.0 μm.

These inorganic/organic composite particles (2-A) and (2-B) were uniformly dispersed in silicone oil following a procedure identical to that of Example 1 so as to produce a percentage contained of 33 weight percent, and thus the ER fluid compositions of Examples (2-A) and (2-B) were obtained.

The ER effects of these fluid compositions were measured in a manner identical to that of Example 1. The results thereof are shown in Table 2.

TABLE 2

| Example | | Applied Voltage | Shear Rate ($s^{-1}$) 320 | 191 | 115 | 68.5 | 40.9 | 24.9 | 14.2 | 8.9 | 4.2 | 2.5 | 1.4 |
|---|---|---|---|---|---|---|---|---|---|---|---|---|---|
| 2-A | Shear Stress (Pa) | E = 0 | 918 | 553 | 335 | 206 | 126 | 79.4 | 49.6 | 32.2 | 16.4 | 11.2 | 8.18 |
| | | E = 2 KV/mm | 982 | 613 | 397 | 260 | 187 | 136 | 102 | 76.9 | 57.0 | 44.6 | 42.2 |
| | Current Density ($\mu A/cm^2$) | | <1.3 | <1.3 | <1.3 | <1.3 | <1.3 | <1.3 | 1.3 | 1.3 | 1.3 | 1.3 | 2.6 |
| 2-B | Shear Stress (Pa) | E = 0 | 905 | 558 | 335 | 206 | 124 | 76.9 | 47.1 | 29.8 | 15.4 | 9.92 | 7.44 |
| | | E = 2 KV/mm | 1030 | 695 | 503 | 382 | 315 | 268 | 236 | 213 | 174 | 124 | 112 |
| | Current Density ($\mu A/cm^2$) | | <1.3 | <1.3 | <1.3 | <1.3 | <1.3 | <1.3 | <1.3 | <1.3 | <1.3 | <1.3 | <1.3 |

Example 3

A process was followed which was identical to that of Example 1, with the exception that 40 g of titanium hydroxide (common name: water-containing titanium oxide, produced by Ishihara Sangyo Kaisha, Ltd., C-II, conductivity: $9.1\times10^{-6}$ $\Omega^{-1}$/cm) was used in place of the antimony-doped tin oxide used in Example 1, and inorganic/organic composite particles (3-A), the surfaces of which were not polished, were obtained. The water content of these particles was 0.66 weight percent, and the average particle diameter was 17.3 μm.

Next, these particles were subjected to jetstream-blown agitation in a manner identical to that of Example 1, and inorganic/organic composite particles (3-B), the surfaces of which were polished, were obtained. The water content of these particles was 0.72 weight percent, and the average particle diameter was 17.3 μm.

These inorganic/organic composite particles (3-A) and (3-B) were uniformly dispersed in silicone oil following a procedure identical to that of Example 1 so that the percentage contained thereof was 33 weight percent, and thus the ER fluid compositions of Examples (3-A) and (3-B) were obtained.

The ER effects of these fluid compositions were measured in a manner identical to that of Example 1. The results thereof are shown in Table 3.

TABLE 3

| Example | | Applied Voltage | Shear Rate ($s^{-1}$) 320 | 191 | 115 | 68.5 | 40.9 | 24.9 | 14.2 | 8.9 | 4.2 | 2.5 | 1.4 |
|---|---|---|---|---|---|---|---|---|---|---|---|---|---|
| 3-A | Shear Stress (Pa) | E = 0 | 980 | 593 | 357 | 219 | 135 | 81.8 | 52.1 | 31.5 | 16.6 | 11.9 | 7.94 |
| | | E = 2 KV/mm | 1000 | 620 | 392 | 243 | 154 | 96.7 | 64.5 | 42.7 | 24.8 | 17.4 | 10.7 |
| | Current Density (μA/cm²) | | <1.3 | <1.3 | <1.3 | <1.3 | <1.3 | <1.3 | <1.3 | <1.3 | <1.3 | <1.3 | <1.3 |
| 3-B | Shear Stress (Pa) | E = 0 | 868 | 521 | 315 | 191 | 114 | 70.7 | 39.7 | 26.0 | 12.9 | 7.94 | 5.46 |
| | | E = 2 KV/mm | 1020 | 759 | 578 | 496 | 382 | 293 | 231 | 188 | 143 | 122 | 107 |
| | Current Density (μA/cm²) | | <1.3 | <1.3 | <1.3 | <1.3 | <1.3 | <1.3 | <1.3 | <1.3 | <1.3 | <1.3 | <1.3 |

Example 4

A process was followed which was identical to that of Example 1, with the exception that niobium hydroxide (produced by Mitsui Mining & Smelting Co., Ltd., niobium hydroxide, conductivity: $1.0\times10^{-7}$ $\Omega^{-1}$/cm) was used in place of the antimony-doped tin oxide which was used in Example 1, and inorganic/organic composite particles (4-A), the surfaces of which were not polished, were obtained. The water content of these particles was 1.86 weight percent, and the average particle diameter was 15.7 μm.

Next, these particles were subjected to jetstream-blown agitation in a manner identical to that of Example 1, and inorganic/organic composite particles (4-B), the surfaces of which were polished, were obtained. The water content of these particles was 1.10 weight percent, and the average particle diameter was 15.4 μm.

These inorganic/organic composite particles (4-A) and (4-B) were uniformly dispersed in silicone oil following a manner identical to that of Example 1 so that the percentage contained thereof was 33 weight percent, and thus the ER fluid compositions of Examples (4-A) and (4-B) were obtained.

The ER effects of these fluid compositions were measured in a manner identical to that of Example 1. The results thereof are shown in Table 4.

TABLE 4

| Example | | Applied Voltage | Shear Rate ($s^{-1}$) 115 | 68.5 | 40.9 | 24.9 | 14.2 | 8.9 |
|---|---|---|---|---|---|---|---|---|
| 4-A | Shear Stress (Pa) | E = 0 | 452 | 290 | 186 | 127 | 80.7 | 55.4 |
| | | E = 2 KV/mm | 463 | 295 | 190 | 131 | 91.0 | 63.3 |
| | Current Density (μA/cm²) | | <5 | <5 | <5 | <5 | <5 | <5 |
| 4-B | Shear Stress (Pa) | E = 0 | 414 | 259 | 164 | 108 | 72.8 | 51.4 |
| | | E = 2 KV/mm | 430 | 281 | 206 | 174 | 154 | 134 |
| | Current Density (μA/cm²) | | <5 | <5 | <5 | <5 | <5 | <5 |

Example 5

A process was followed which was identical to that of Example 1, with the exception that 40 g of an amorphous-type titanium dioxide (produced by Idemitsu Petrochemical Co., Ltd., Idemitsu Titania IT-PC, conductivity: $9.1\times10^{-11}$ $\Omega^{-1}$/cm) was used in place of the antimony-doped tin oxide used in Example 1, and inorganic/organic composite particles (5-A), the surfaces of which were not polished, were obtained. The water content of these particles was 1.24 weight percent, and the average particle diameter was 18.0 μm.

Next, these particles were subjected to jetstream-blown agitation in a manner identical to that of Example 1, and inorganic/organic composite particles (5-B), the surfaces of which were polished, were obtained. The water content of these particles was 0.94 weight percent, and the average particle diameter was 17.9 μm.

These inorganic/organic composite particles (5-A) and (5-B) were uniformly dispersed in silicone oil in a manner identical to that of Example 1 so that the percentage contained thereof was 33 weight percent, and thus the ER fluid compositions of Examples (5-A) and (5-B) were obtained.

The ER effects of these fluid compositions were measured in a manner identical to that of Example 1. The results thereof are shown in Table 5.

TABLE 5

| Example | | Applied Voltage | Shear Rate ($s^{-1}$) 115 | 68.5 | 40.9 | 24.9 | 14.2 | 8.9 | 4.2 | 2.5 | 1.4 |
|---|---|---|---|---|---|---|---|---|---|---|---|
| 5-A | Shear Stress (Pa) | E = 0 | 382 | 228 | 139 | 84.3 | 53.5 | 33.5 | 16.6 | 9.42 | ** |
| | | E = 2 KV/mm | 456 | 312 | 226 | 171 | 136 | 115 | 91.8 | 83.1 | 78.1 |
| | Current Density ($\mu A/cm^2$) | | <1.3 | <1.3 | <1.3 | <1.3 | <1.3 | <1.3 | <1.3 | <1.3 | <1.3 |
| 5-B | Shear Stress (Pa) | E = 0 | 350 | 210 | 126 | 78.1 | 45.9 | 29.8 | 14.9 | 9.48 | ** |
| | | E = 2 KV/mm | 558 | 451 | 397 | 377 | 342 | 310 | 285 | 270 | 268 |
| | Current Density ($\mu A/cm^2$) | | <1.3 | <1.3 | <1.3 | <1.3 | <1.3 | <1.3 | <1.3 | <1.3 | <1.3 |

**Could not be measured because of low shear stress

Example 6

A process was followed which was identical to that of Example 1, with the exception that 40 g of amorphous-type titanium dioxide (produced by Idemitsu Petrochemical Co., Ltd., Idemitsu Titania IT-S, conductivity: $7.7\times10^{-11}$ $\Omega^{-1}$/cm) was used in place of the antimony-doped tin oxide used in Example 1, and inorganic/organic composite particles (6-A), the surfaces of which were not polished, were obtained. The water content of these particles was 0.66 weight percent, and the average particle diameter was 16.1 μm.

Next, these particles were subjected to jetstream-blown agitation in a manner identical to that of Example 1, and inorganic/organic composite particles (6-B), the surfaces of which were polished, were obtained. The water content of these particles was 0.58 weight percent, and the average particle diameter was 16.9 μm.

These inorganic/organic composite particles (6-A) and (6-B) were uniformly dispersed in silicone oil in a manner identical to that of Example 1 so that the percentage contained thereof was 33 weight percent, and thus the ER fluid compositions of Examples (6-A) and (6-B) were obtained.

The ER effects of these fluid compositions were measured in a manner identical to that of Example 1. The results thereof are shown in Table 6.

TABLE 6

| Example | | Applied Voltage | Shear Rate ($s^{-1}$) 115 | 68.5 | 40.9 | 24.9 | 14.2 | 8.9 | 4.2 | 2.5 | 1.4 |
|---|---|---|---|---|---|---|---|---|---|---|---|
| 6-A | Shear Stress (Pa) | E = 0 | 402 | 239 | 145 | 88.0 | 53.3 | 31.5 | 14.9 | 9.18 | ** |
| | | E = 2 KV/mm | 451 | 312 | 236 | 193 | 159 | 134 | 109 | 102 | 95.5 |
| | Current Density ($\mu A/cm^2$) | | <1.3 | <1.3 | <1.3 | <1.3 | <1.3 | <1.3 | <1.3 | <1.3 | <1.3 |
| 6-B | Shear Stress (Pa) | E = 0 | 345 | 206 | 124 | 75.6 | 45.9 | 27.3 | 12.4 | 7.44 | ** |
| | | E = 2 KV/mm | 553 | 469 | 422 | 419 | 374 | 335 | 295 | 273 | 263 |
| | Current Density ($\mu A/cm^2$) | | <1.3 | <1.3 | <1.3 | <1.3 | <1.3 | <1.3 | <1.3 | <1.3 | <1.3 |

**Could not be measured because of low shear stress

Example 7

A process was followed which was identical to that of Example 1, with the exception that 40 g of FeO(OH) (common name: gacite, produced by Ishihara Sangyo Kaisha, Ltd., gacite A, conductivity: $9.4\times10^{-8}$ $\Omega^{-1}$/cm) was used in place of the antimony-doped tin oxide used in Example 1, and inorganic/organic composite particles (7-A), the surfaces of which were not polished, were obtained. The water content of these particles was 0.42 weight percent, and the average particle diameter was 10.1 μm.

Next, these particles were subjected to jetstream-blown agitation in a manner identical to that of Example 1, and inorganic/organic composite particles (7-B), the surfaces of which were polished, were obtained. The water content of these particles was 0.68 weight percent, and the average particle diameter was 10.1 μm.

These inorganic/organic composite particles (7-A) and (7-B) were uniformly dispersed in silicone oil in a manner identical to that of Example 1 so that the percentage contained thereof was 33 weight percent, and thus the ER fluid compositions of Examples (7-A) and (7-B) were obtained.

The ER effects of these fluid compositions were measured in a manner identical to that of Example 1. The results thereof are shown in Table 7.

TABLE 7

| Example | Applied Voltage | Shear Rate ($s^{-1}$) 320 | 191 | 115 | 68.5 | 40.9 | 24.9 | 14.2 | 8.9 | 4.2 | 2.5 | 1.4 |
|---|---|---|---|---|---|---|---|---|---|---|---|---|
| 7-A | Shear Stress (Pa) E = 0 | 1030 | 625 | 389 | 241 | 155 | 102 | 69.4 | 47.1 | 28.5 | 19.8 | 12.4 |
| | E = 2 KV/mm | 1040 | 637 | 402 | 263 | 181 | 135 | 109 | 91.8 | 73.2 | 62.0 | 52.1 |
| | Current Density ($\mu A/cm^2$) | <1.3 | <1.3 | <1.3 | <1.3 | <1.3 | <1.3 | <1.3 | <1.3 | <1.3 | <1.3 | <1.3 |
| 7-B | Shear Stress (Pa) E = 0 | 915 | 526 | 322 | 195 | 118 | 73.2 | 43.4 | 27.3 | 13.6 | 8.68 | ** |
| | E = 2 KV/mm | 1290 | 608 | 357 | 211 | 134 | 104 | 107 | 102 | 91.8 | 81.8 | 62.0 |
| | Current Density ($\mu A/cm^2$) | <1.3 | <1.3 | <1.3 | <1.3 | <1.3 | <1.3 | <1.3 | <1.3 | <1.3 | <1.3 | <1.3 |

**Could not be measured because of low shear stress

Example 8

A process was followed which was identical to that of Example 1, with the exception that 20 g of the titanium hydroxide employed in Example 3, and 20 g of the niobium hydroxide employed in Example 4 were mixed and used in place of the antimony-doped tin oxide used in Example 1, and inorganic/organic composite particles (8-A), the surfaces of which were not polished, were obtained. The water content of these particles was 0.89 weight percent, and the average particle diameter was 17.8 μm.

Next, these particles were subjected to jetstream-blown agitation in a manner identical to that of Example 1, and inorganic/organic composite particles (8-B), the surfaces of which were polished, were obtained. The water content of these particles was 0.59 weight percent, and the average particle diameter was 20.0 μm.

These particles were uniformly dispersed in silicone oil in a manner identical to that of Example 1 so that the percentage contained thereof reached 33 weight percent, and thus the ER fluid compositions of Examples (8-A) and (8-B) were obtained.

The ER effects of these fluid compositions were measured in a manner identical to that of Example 1. The results thereof are shown in Table 8.

TABLE 8

| Example | Applied Voltage | Shear Rate ($s^{-1}$) 320 | 191 | 115 | 68.5 | 40.9 | 24.9 | 14.2 | 8.9 | 4.2 | 2.5 | 1.4 |
|---|---|---|---|---|---|---|---|---|---|---|---|---|
| 8-A | Shear Stress (Pa) E = 0 | 1030 | 615 | 365 | 218 | 134 | 84.3 | 52.1 | 32.2 | 16.1 | 10.4 | 6.70 |
| | E = 2 KV/mm | 1040 | 633 | 370 | 220 | 135 | 87.0 | 55.0 | 33.5 | 16.6 | 10.7 | 6.90 |
| | Current Density ($\mu A/cm^2$) | <1.3 | <1.3 | <1.3 | <1.3 | <1.3 | <1.3 | <1.3 | <1.3 | <1.3 | <1.3 | <1.3 |
| 8-B | Shear Stress (Pa) E = 0 | 952 | 670 | 397 | 236 | 143 | 89.3 | 53.3 | 32.2 | 16.1 | 9.92 | 5.70 |
| | E = 2 KV/mm | 1560 | 734 | 476 | 347 | 211 | 179 | 181 | 186 | 171 | 164 | 161 |
| | Current Density ($\mu A/cm^2$) | <1.3 | <1.3 | <1.3 | <1.3 | <1.3 | <1.3 | <1.3 | <1.3 | <1.3 | <1.3 | <1.3 |

Example 9

A mixture of 40 g of the titanium hydroxide which was employed in Example 3, 260 g of butyl acrylate, 40 g of hydroxyethyl methacrylate, 100 g of 1,3-butylene glycol methacrylate, and polymerization initiator was dispersed in 1800 ml of water containing 25 g of tertiary calcium phosphate as a dispersion stabilizer; this was agitated for a period of 1 hour at a temperature of 60° C. and suspension polymerization was conducted.

The product thus obtained was subjected to filtration, and where necessary, acid cleaning, and water rinsing and drying, and inorganic/organic composite particles (9-A) were obtained. The water content of these particles was measured at 1.00 weight percent by means of Karl Fisher's titration method. Furthermore, the average particle diameter was 16.3 μm.

The inorganic/organic composite particles (9-A) which were thus obtained were subjected to jetstream-blown agitation for a period of 5 minutes at 6,000 rpm using a jetstream agitator (a hybridizer manufactured by Nara Machinery Company, Ltd.), and inorganic/organic composite particles (9-B), the surfaces of which were polished, were obtained. The water content of these particles was 0.64 weight percent, and the average particle diameter was 15.4 μm.

These inorganic/organic composite particles (9-A) and (9-B) were uniformly dispersed in silicone oil having a viscosity of 1 Pa·s at room temperature, so that the amount contained thereof was 33 weight percent, and the ER fluid compositions of Examples (9-A) and (9-B) were obtained.

These compositions were placed in a coaxial cylinder viscometer, a direct current voltage was applied between the inner and outer cylinders at a temperature of 25° C., and a torque was applied to the inner cylinder electrode, and the shear stress (Pa) at various shear rates ($s^{-1}$), and the current value ($\mu A/cm^2$) between the inner and outer cylinder during the measurement of shear stress, were measured. The results thereof are shown in Table 9.

TABLE 9

| Example | Applied Voltage | Shear Rate ($s^{-1}$) 115 | 68.5 | 40.9 | 24.9 | 14.2 | 8.9 | 4.2 | 2.5 | 1.4 |
|---|---|---|---|---|---|---|---|---|---|---|
| 9-A | Shear Stress (Pa) E = 0 | 372 | 228 | 138 | 84.3 | 52.1 | 32.2 | 16.1 | 9.92 | ** |
| | Shear Stress (Pa) E = 2 KV/mm | 389 | 248 | 159 | 102 | 65.7 | 44.6 | 24.8 | 15.6 | 10.6 |
| | Current Density ($\mu A/cm^2$) | <1.3 | <1.3 | <1.3 | <1.3 | <1.3 | <1.3 | <1.3 | <1.3 | <1.3 |
| 9-B | Shear Stress (Pa) E = 0 | 335 | 203 | 122 | 75.6 | 44.6 | 26.5 | 12.4 | 7.44 | ** |
| | Shear Stress (Pa) E = 2 KV/mm | 670 | 603 | 533 | 466 | 372 | 337 | 273 | 248 | 226 |
| | Current Density ($\mu A/cm^2$) | <1.3 | <1.3 | <1.3 | <1.3 | <1.3 | <1.3 | <1.3 | <1.3 | <1.3 |

**Could not be measured because of low shear stress

Example 10

A process was followed which was identical to that of Example 9, with the exception that 40 g of methacrylic acid was used in place of the hydroxyethyl methacrylate which was used in Example 9 and inorganic/organic composite particles (10-A), the surfaces of which were polished, were obtained. The water content of these particles was 1.44 weight percent, and the average particle diameter was 18.0 μm.

Next, these particles were subjected to jetstream-blown agitation in a manner identical to that of Example 9, and inorganic/organic composite particles (10-B), the surfaces of which were polished, were obtained. The water content of these particles was 0.91 weight percent, and the average particle diameter was 17.0 μm.

The inorganic/organic composite particles (10-A) and (10-B) were uniformly dispersed in silicone oil in a manner identical to that of Example 9 so that the percentage contained thereof was 33 weight percent, and thus the ER fluid compositions of Examples (10-A) and (10-B) were obtained.

The ER effects of these fluid compositions were measured in a manner identical to that of Example 9. The results thereof are shown in Table 10.

TABLE 10

| Example | Applied Voltage | Shear Rate ($s^{-1}$) 115 | 68.5 | 40.9 | 24.9 | 14.2 | 8.9 | 4.2 | 2.5 | 1.4 |
|---|---|---|---|---|---|---|---|---|---|---|
| 10-A | Shear Stress (Pa) E = 0 | 372 | 228 | 142 | 86.8 | 52.1 | 31.5 | 15.4 | 9.18 | ** |
| | Shear Stress (Pa) E = 2 KV/mm | 404 | 236 | 145 | 88.5 | 54.7 | 33.5 | 16.6 | 11.2 | ** |
| | Current Density ($\mu A/cm^2$) | <1.3 | <1.3 | <1.3 | <1.3 | <1.3 | <1.3 | <1.3 | <1.3 | <1.3 |
| 10-B | Shear Stress (Pa) E = 0 | 342 | 203 | 122 | 74.4 | 45.9 | 26.0 | 11.7 | 6.94 | ** |
| | Shear Stress (Pa) E = 2 KV/mm | 526 | 404 | 330 | 283 | 238 | 203 | 161 | 139 | 131 |
| | Current Density ($\mu A/cm^2$) | <1.3 | <1.3 | <1.3 | <1.3 | <1.3 | <1.3 | <1.3 | <1.3 | <1.3 |

**Could not be measured because of low shear stress

Example 11

A process was followed which was identical to that of Example 3, with the exception that 80 g of titanium hydroxide was used in place of the 40 g of titanium hydroxide which was used in Example 3, and inorganic/organic composite particles (11-A), the surfaces of which were not polished, and inorganic/organic composite particles (11-B), the surfaces of which were polished, were obtained.

Using the inorganic/organic composite particles (11-A), the ER fluid composition of Example (11-A) was obtained, and using the inorganic/organic composite particles (11-B), the ER fluid composition of Example (11-B) was obtained. Next, the shear stresses (Pa) at various shear rates ($s^{-1}$), and the current value ($\mu A/cm^2$) at these times, were measured in a manner identical to that of Example 1. The results thereof are shown in Table 11.

TABLE 11

| Example | Applied Voltage | Shear Rate ($s^{-1}$) 115 | 68.5 | 40.9 | 24.9 | 14.2 | 8.9 |
|---|---|---|---|---|---|---|---|
| 11-A | Shear Stress (Pa) E = 0 | 403 | 249 | 158 | 103 | 71.2 | 47.5 |
| | Shear Stress (Pa) E = 2 KV/mm | 427 | 269 | 174 | 119 | 83.1 | 63.3 |
| | Current Density ($\mu A/cm^2$) | <5 | <5 | <5 | <5 | <5 | <5 |
| 11-B | Shear Stress (Pa) E = 0 | 403 | 245 | 150 | 94.9 | 59.3 | 37.1 |
| | Shear Stress (Pa) E = 2 KV/mm | 728 | 566 | 447 | 360 | 293 | 249 |
| | Current Density ($\mu A/cm^2$) | <5 | <5 | <5 | <5 | <5 | <5 |

Example 12

The ER fluid composition of Example (11-B) above was placed in a tightly sealed transparent vessel, this was stored at room temperature, and the sedimentation state thereof was visually evaluated. The results thereof are shown in Table 12 as Example 12.

Comparative Example 1

5.5 weight percent of a powder consisting solely of titanium hydroxide was caused to be contained in the ER fluid composition of Example (11-B) in place of the inorganic/organic composite particles (11-B), and this was used as the ER fluid composition of Comparative Example 1. The sedimentation state of this was visually evaluated in a manner identical to Example 12. The results thereof are shown in Table 12 for the purposes of comparison with Example 12. In Table 12, a ○ indicates that sedimentation was not observed, while an X symbol indicates that sedimentation was observed.

TABLE 12

| | After 1 Day | After 3 Days | After 3 Weeks |
|---|---|---|---|
| Example 11-B | ◎ | ◎ | ◎ |
| Comparative Example 1 | ◎ | X | X |

◎: Sedimentation was not observed
X: Sedimentation was observed

Example 13

A reciprocating motion level surface abrasion test was conducted in accordance with JIS H8682 (testing method for resistance to abrasion of the layer subjected to anodic oxidation of aluminum and aluminum alloy) using the ER fluid composition of Example (11-B) as the subject thereof. That is to say, on an aluminum plate in accordance with JIS H4000 A1050P, in place of a friction ring, a 4 $cm^2$ friction sliding device having placed thereon 10 sheets of gauze on which 1 g of the fluid was placed, was moved back and forth for 10 strokes under a load of 55 $g/cm^2$, and the state of the surface of the aluminum plate was visually evaluated. The results thereof are shown in Table 13 as Example 13.

Comparative Example 2

A powder consisting solely of titanium hydroxide was uniformly dispersed in silicone oil so that the percentage contained thereof was 33 weight percent, in place of the inorganic/organic composite particles (11-A) in the ER fluid composition of Example (11-A), and the fluid composition of Comparative Example 2 was obtained.

A reciprocating motion level surface abrasion test was conducted with respect to the fluid composition which was thus obtained by a method which was identical to that of Example 13. The results thereof are shown in Table 13 for the purposes of comparison with Example 13. In Table 13, a ○ indicates that there was no change in the surface of the aluminum plate, and evidence of damage was not observed, while an X symbol indicates that multiple traces of damage were observed.

TABLE 13

| | State of Aluminum Plate Surface |
|---|---|
| Example 13 | ◎ |
| Comparative Example 2 | X |

◎: No change (evidence of damage was not observed)
X: Multiple traces of damage were observed Example 14

The surface atomic ratio of carbon, oxygen, and titanium atoms of the inorganic/organic composite particles (3-A) having unpolished surfaces, and the inorganic/organic composite particles (3-B) having polished surfaces which were obtained in Example 3 were measured (the measurement conditions were such that the excitation source was Mg(Kα) and the output was 260 W) in a high resolution X-ray photoelectron spectrograph (ESCALAB MKII, manufactured by the VG Scientific Company of England), and the measurement results of the composite particles (3-A) having unpolished surfaces are shown in Table 14 as Example (14-A),. while the measurements of the composite particles (3-B) having polished surfaces are shown in Table 14 as Example (14-B).

TABLE 14

| | Inorganic/ Organic Composite Particles | Carbon Atoms (%) | Oxygen Atoms (%) | Titanium Atoms (%) |
|---|---|---|---|---|
| Example 14-A | (3-A) | 64.83 | 28.27 | 6.90 |
| Example 14-B | (3-B) | 47.06 | 39.49 | 13.46 |

From the results of Table 14, it can be seen that in comparison with the inorganic/organic composite particles (3-A) which were not subjected to jetstream blown agitation, the inorganic/organic composite particles (3-B) which were subjected to jetstream blown agitation had a surface carbon atom ratio which was small, while the titanium atom ratio was large. This corresponds to the fact that, as can be seen in Table 3, the ER fluid composition utilizing the inorganic/organic composite particles (3-B) which were subjected to jetstream blown agitation exhibits ER effects which are greater than those of the ER fluid composition which utilized the inorganic/organic composite particles (3-A) which were unpolished.

From these results, it can be concluded that in the inorganic/organic composite particles shown in the above examples, which were produced by means of a method in which the core and the shell were simultaneously formed, there is a possibility that a part of the shell will be covered by a thin film of core material or an additive material such as dispersant or emulsifier, and that by the means of the removal of this layer covering this shell using friction polishing by means of jetstream blown agitation, the effective active surface of the electrically semiconducting inorganic material particle layer is increased, so that when an ER fluid composition is made therefrom, greater ER effects are exhibited.

From the above effects, it is clear that the ER fluid compositions comprising examples of the present invention all possess superior ER effects and possess thermal resistance, stability, low abrasiveness, and have a small power consumption.

What is claimed is:

1. An electrorheological fluid composition comprising inorganic/organic composite particles dispersed in an electrically insulating medium, said inorganic/organic composite particles consisting essentially of a core consisting of an electrically insulating organic polymeric compound and a single shell consisting essentially of microparticles of an electrically semiconducting inorganic material having an electrical conductivity within a range of $10^3$ to $10^{-11}$ $\Omega^{-1}$/cm at room temperature, wherein the electrically semiconducting inorganic material are metal oxides, metal hydroxides, hydroxides of metal oxides, or inorganic ion exchangers, or metal oxides, metal hydroxides, hydroxides of metal oxides, or inorganic ion exchangers which are subjected to metallic doping, and wherein the electrically insulating organic polymeric compound is at least one of poly(meth)acrylic ester, (meth)acrylic ester-styrene copolymer, polystyrene, polyethylene, polypropylene, nitrile rubber, butyl rubber, ABS resin, nylon, polyvinyl butyrate, ionomer, ethylene-vinyl acetate copolymer, vinyl acetate resin, or polycarbonate resin.

2. An electrorheological fluid composition according to claim 1, wherein said inorganic/organic composite particles are produced by a method in which cores and shells thereof are formed simultaneously by one of emulsion polymerization, suspension polymerization, or dispersion polymerization in the presence of said electrically semiconducting inorganic microparticles.

3. An electrorheological fluid composition according to claim 2, wherein said inorganic/organic composite particles have polished surfaces.

4. An electrorheological fluid composition according to claim 1, wherein said microparticles of an electrically semiconducting inorganic material consist of a support member coated with said electrically semiconducting inorganic material, thereby forming at least a surface of said electrically semiconducting inorganic material on said support member.

5. An electrorheological fluid composition according to claim 4, wherein said inorganic/organic composite particles are produced by a method in which cores and shells thereof are formed simultaneously by one of emulsion polymerization, suspension polymerization, or dispersion polymerization in the presence of said electrically semiconducting inorganic microparticles.

* * * * *

UNITED STATES PATENT AND TRADEMARK OFFICE

CERTIFICATE OF CORRECTION

PATENT NO. : 5,736,064

DATED : April 07, 1998

INVENTOR(S) : Kazuya EDAMURA et al.

It is certified that error appears in the above-identified patent and that said Letters Patent is hereby corrected as shown below:

Title page, column 2, item [57], line 6 of Abstract, "$10^{3-10-11}$" should read --$10^{3}$-$10^{-11}$--.

Title page, column 2, item [45], the date of the patent should read --*April 7, 1998--.

Title page, column 1, between item [73] and item [21] there should be inserted:

--[*] Notice: The term of this patent shall not extend beyond the expiration date of Patent No. 5,695,678.--

Signed and Sealed this

Twenty-fifth Day of August, 1998

Bruce Lehman

*Attest:*

BRUCE LEHMAN

*Attesting Officer*

*Commissioner of Patents and Trademarks*